US008152454B2

(12) United States Patent
Khanin et al.

(10) Patent No.: US 8,152,454 B2
(45) Date of Patent: Apr. 10, 2012

(54) STATOR VANE FOR A GAS TURBINE ENGINE

(75) Inventors: Alexander Khanin, Moscow (RU); Igor Kurganov, Samara (RU); Sergey Vorontsov, Moscow (RU); Victor Odinokov, Moscow (RU)

(73) Assignee: Alstom Technology Ltd, Baden (CH)

( * ) Notice: Subject to any disclaimer, the term of this patent is extended or adjusted under 35 U.S.C. 154(b) by 162 days.

(21) Appl. No.: 12/646,365

(22) Filed: Dec. 23, 2009

(65) Prior Publication Data

US 2010/0150710 A1 Jun. 17, 2010

Related U.S. Application Data

(63) Continuation of application No. PCT/EP2008/057947, filed on Jun. 23, 2008.

(30) Foreign Application Priority Data

Jun. 28, 2007 (CH) ..... 1044/07

(51) Int. Cl.
*F01D 25/26* (2006.01)

(52) U.S. Cl. ..... 415/135; 415/138; 415/208.2

(58) Field of Classification Search ..... 415/135, 415/138, 139, 202, 208.1, 208.2; 277/641
See application file for complete search history.

(56) References Cited

U.S. PATENT DOCUMENTS 3,542,483 A * 11/1970 Gagliardi ..... 415/136
3,938,906 A * 2/1976 Michel et al. ..... 415/139
4,524,980 A 6/1985 Lillibridge et al.
6,419,447 B1 * 7/2002 Watanabe et al. ..... 415/191
7,625,174 B2 * 12/2009 Drerup et al. ..... 415/135
7,922,444 B2 * 4/2011 Propheter-Hinckley ..... 415/139
2007/0140843 A1 6/2007 Drerup et al.

FOREIGN PATENT DOCUMENTS

EP 0147354 A1 7/1985
EP 1798380 A2 6/2007
GB 2195403 A 4/1988

OTHER PUBLICATIONS

International Search Report for CH10442007 dated Oct. 18, 2007.
International search report mailed Feb. 2, 2009, which issued during prosecution of International Patent Application No. PCT/EP2008/057947.

* cited by examiner

*Primary Examiner* — Edward Look
*Assistant Examiner* — Andrew C Knopp
(74) *Attorney, Agent, or Firm* — Leydig, Voit & Mayer, Ltd.

(57) ABSTRACT

A guide vane for a gas turbine includes a vane body having a leading edge and a trailing edge and a shroud extending at least between the leading edge and the trailing edge. The shroud has a first side wall and a second side wall extending essentially radially and in a longitudinal direction of the gas turbine. The first side wall has a groove disposed in a region of the trailing edge extending in a longitudinal direction of the shroud and is configured to receive a sealing plate. The first side wall also has a clearance extending from the groove in a region of the trailing edge, wherein a depth of the clearance in a circumferential direction of the gas turbine is equal to a depth of the groove, and wherein a width of the clearance in the longitudinal direction of the shroud is between one to three times the depth of the clearance.

8 Claims, 5 Drawing Sheets

STATOR VANE FOR A GAS TURBINE ENGINE

This application is a continuation of International Patent Application No. PCT/EP2008/057947, filed on Jun. 23, 2008, which claims priority to Swiss Patent Application No. CH 01044/07, filed on Jun. 28, 2007. The entire disclosure of both applications is incorporated by reference herein.

The present invention relates to a stator vane for a gas turbine engine, in particular a stator vane with a vane platform.

BACKGROUND

In a gas turbine a plurality of stationary stator or guide vanes are used which are arranged in rows along the circumference of the turbine portion. As these stator vanes are subjected to the effects of the hot gases flowing out of the combustion chamber and of the high pressures, high stresses can arise in the stator vanes and the platforms. The platform is situated between the hot gas flow and space filled with cooling air. In order to seal this space from the hot gases the platform usually has side walls which are provided with a groove extending in the longitudinal direction of the platform. The grooves of two neighboring platforms (in the circumferential direction) receive a sealing plate extending between the two platforms. In some cases the distance, in the circumferential direction of the gas turbine, between the trailing edge of the stator vane and the groove can be very small. This can lead to considerable stress concentrations, particularly in the trailing edge of the stator vane and in the platform in the area of the trailing edge of the stator vane. Because of these stress concentrations the life time of the stator vane is significantly reduced.

SUMMARY OF THE INVENTION

The invention addresses these problems. The present invention aims to provide a stator vane for a gas turbine with a platform having an improved design, which reduces the stress concentrations in the trailing edge of the stator vane and in the vane platform in the region of the trailing edge of the stator vane.

According to the invention a stator vane has a leading edge and a trailing edge and a platform extending at least between the leading and trailing edges. The platform has first and second side walls extending substantially in the axial and radial directions of the gas turbine. The first side wall is provided, at least in the area of the trailing edge, with a groove extending in the longitudinal direction of the platform for receiving a sealing plate, whereby the first side wall of the sealing plate in the area of the trailing edge has a recess extending from the groove.

The recess in the vane platform in the area of the trailing edge of the stator vane reduces the stress concentrations in the trailing edge of the stator vane and in the vane platform in the area of the trailing edge of the stator vane. The low cycle fatigue and the creep rate in these areas are therefore reduced.

In an advantageous embodiment of the invention the depth of the recess in the circumferential direction of the gas turbine is the same as the depth of the groove. As used herein, the same depth means substantially or essentially the same depth. Through this, a considerable reduction in the stress concentrations was observed in the trailing edge of the stator vane and in the vane platform in the area of the trailing edge of the stator vane.

The above and other aspects, features and advantages of the invention will become more apparent from the following description of certain preferred embodiments thereof, when taken in conjunction with the accompanying drawings.

BRIEF DESCRIPTION OF THE DRAWINGS

The invention is described referring to an embodiment depicted schematically in the drawings, and will be described with reference to the drawings in more details in the following.

The drawings show schematically in.

DETAILED DESCRIPTION

Figure 5:
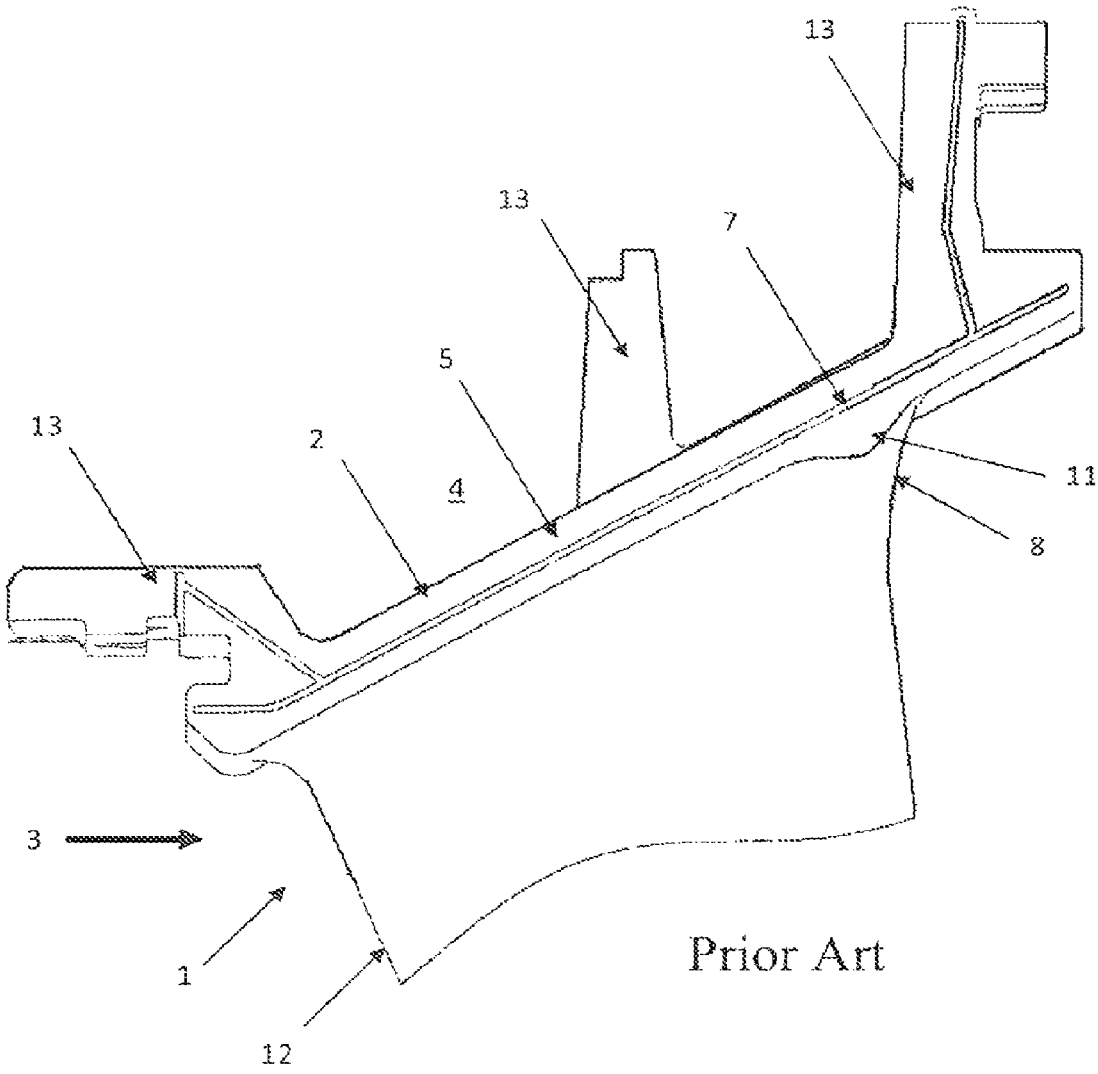
Figure 6:
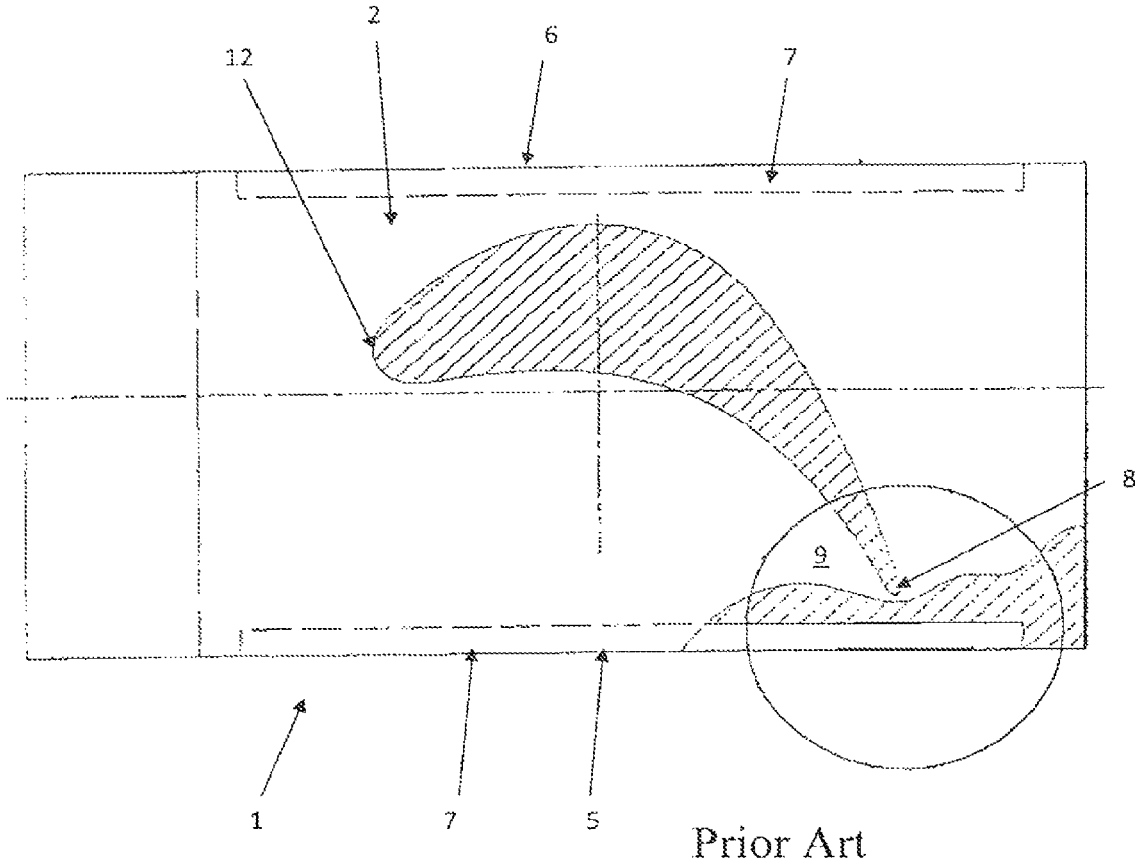

FIGS. 5 and 6 show a prior art stator vane 1 with a vane platform 2. In a gas turbine a plurality of such stationary stator vanes 1 are used, which are arranged in rows around the circumference of a turbine portion.

The stator vane 1 has a leading edge 12 and a trailing edge 8, whereby the vane platform 2 extends at least between the leading edge 12 and the trailing edge 8. Attachment elements 13 are provided on the radially outer side of the vane platform 2 for positioning the stator vane 1 in the radial and circumferential directions.

The vane platform 2 furthermore has side walls 5, 6 extending substantially in the longitudinal and radial directions of the turbine.

The vane platform 2 is located in the radial direction between a hot gas flow 3 and a space 4 filled with cooling air. In order to seal this space 4 from the hot gas flow the side walls 5, 6 are each provided with a groove 7 extending in the longitudinal direction of the vane platform 2. The grooves 7 of two neighboring vane platforms 2 receive a sealing plate which extends between the two vane platforms. A groove 7 extends in the axial direction of the gas turbine at least in the area of a trailing edge 8 of the stator vane 1, and the distance in the circumferential direction of the gas turbine between the trailing edge 8 of the stator vane 1 and the groove 7 can be very small, as can be seen from FIG. 6 which shows a cross section through a radially outer section of the vane portion together with a partial view in the area of the groove 7.

As the stator vane 1 is subjected, in use, to the effects of the hot gases 3 flowing out of the combustion chamber and the high pressures, high stress concentrations can arise in the trailing edge area of the stator vane 1 and in the vane platform 2 in the area of the trailing edge area of the stator vane 1. The life of the stator vane 1 is considerably reduced due to these stress concentrations in the area inside the circle 9 in FIG. 6. In FIGS. 5 and 6 a stator vane 1 is provided with a radially outer vane platform. The stator vane 1 can however also be provided with a radially inner vane platform, which is similarly provided with a groove in the longitudinal direction of the vane platform, whereby in use stress concentrations arise in the trailing edge area of the stator vane 1 and in the radially inner vane platform in the region of the trailing edge 8 of the stator vane 1.

Figure 1:
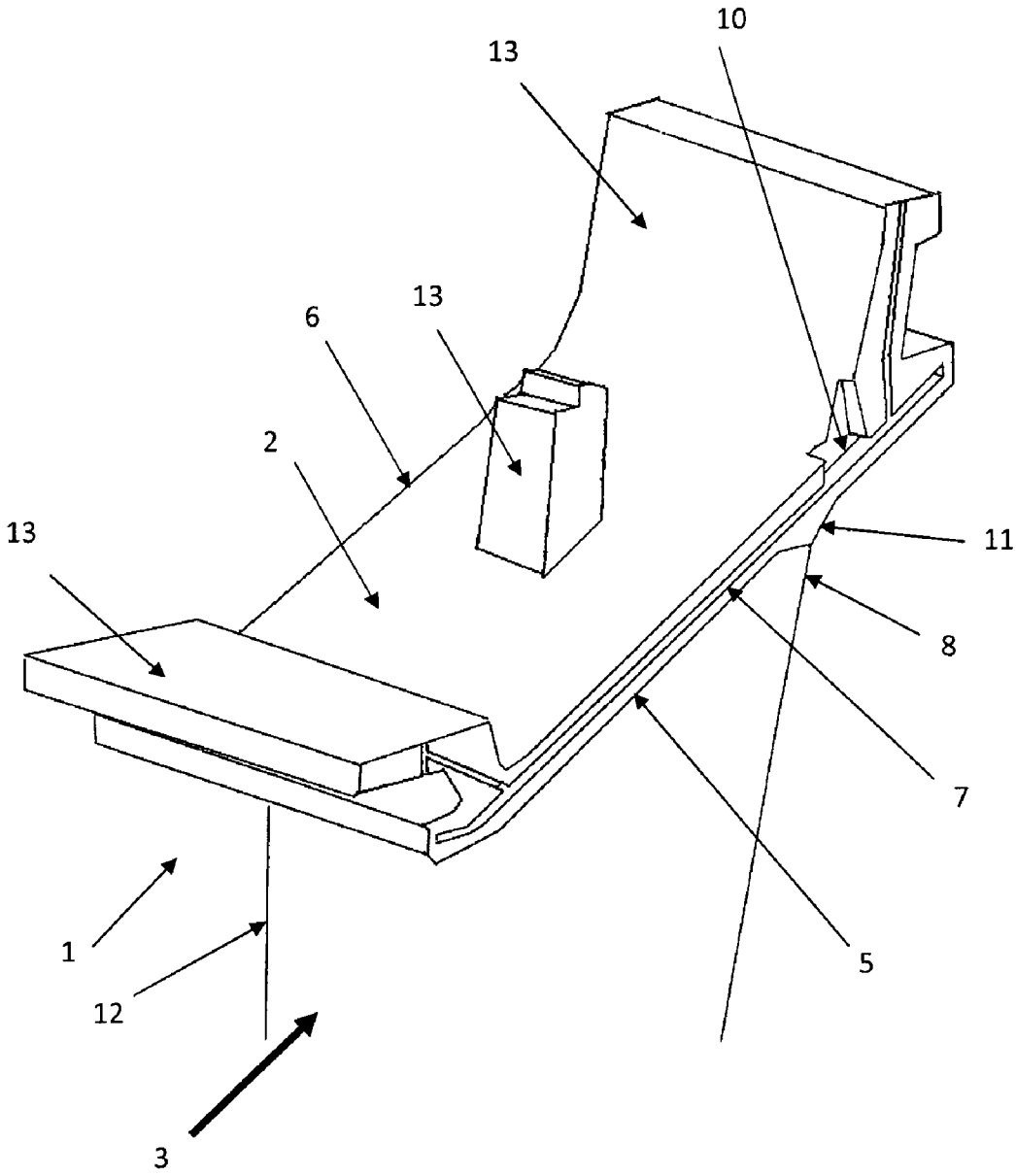
FIG. 1 a perspective view of a stator vane with a platform according to an advantageous embodiment of the invention, FIG. 2 a side view of a stator vane with a platform according to an advantageous embodiment of the invention FIG. 3 the relationship between the trailing edge of the stator vane and the recess according to an advantageous embodiment of the invention, FIG. 4 a sectional view of the platform in FIG. 2 through the line A-A, FIG. 5 a side view of a prior art stator vane with a platform, FIG. 6 the relationship between the trailing edge of a prior art stator vane and the groove in the vane platform.
Figure 2:
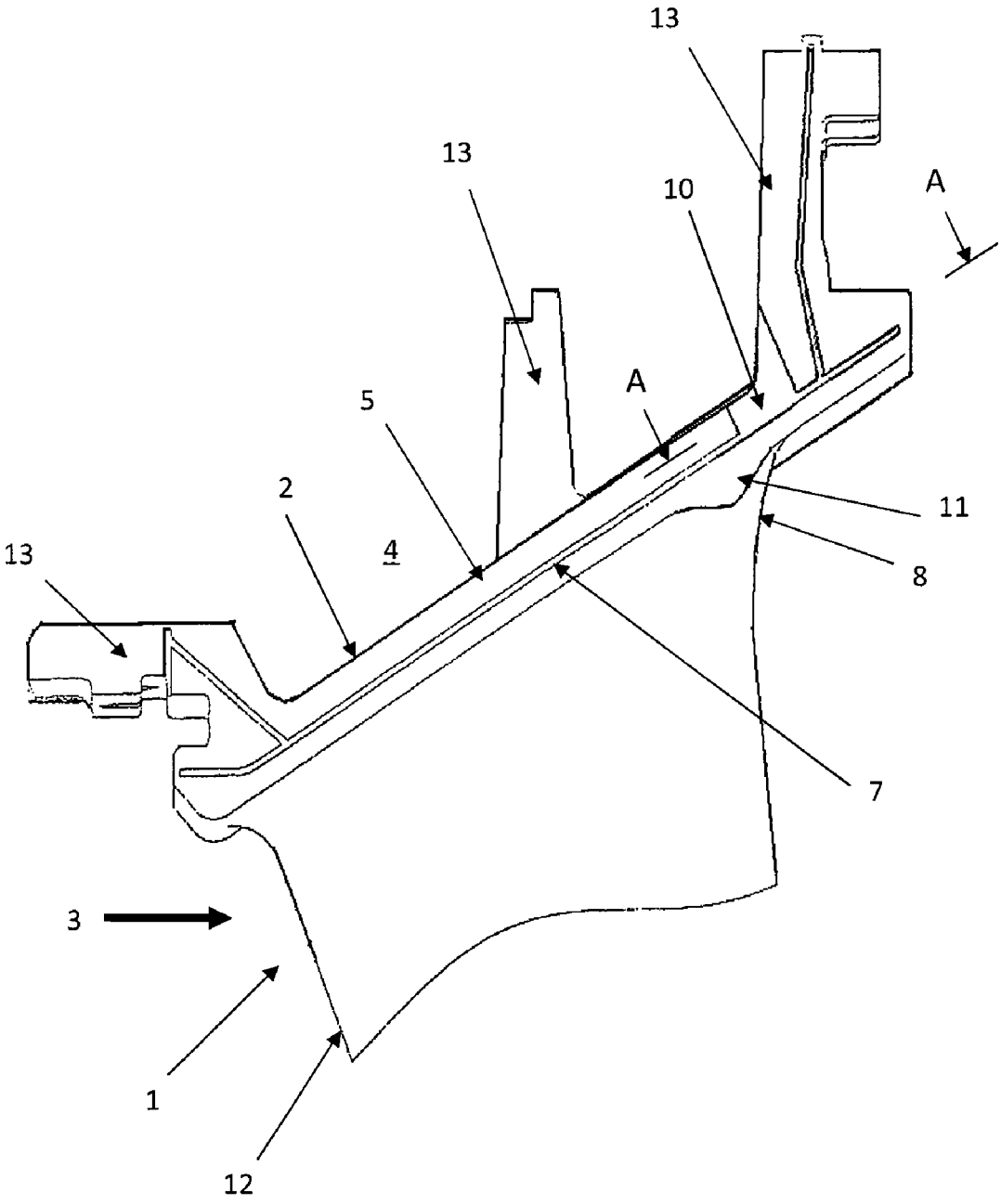

FIG. 1 shows a stator vane 1 comprising a vane platform 2 according to a preferred embodiment of the invention. Similar elements are provided with similar reference numerals. According to the invention a first side wall 5 of the vane platform 2 in the area of the trailing edge 8 is provided with a recess 10 extending from the groove 7. In the preferred embodiment the recess 10 is provided opposite the trailing edge 8 in the longitudinal direction of the vane platform 2. As used herein, opposite means essentially opposite. The recess 10 preferably extends radially outwards and perpendicular to the groove 7. In particular only the first side wall 5 has such a recess 10.

The vane platform 2 can be provided with a raised portion 11 on the opposite side to the recess 10 in the radial direction, whereby the recess 10 is provided in the area of the raised portion 11 in the longitudinal direction of the vane platform 2. In particular, the recess 10 can be arranged in the area of a downstream end of the raised portion 11 in the longitudinal direction of the vane platform 2.

Figure 3:
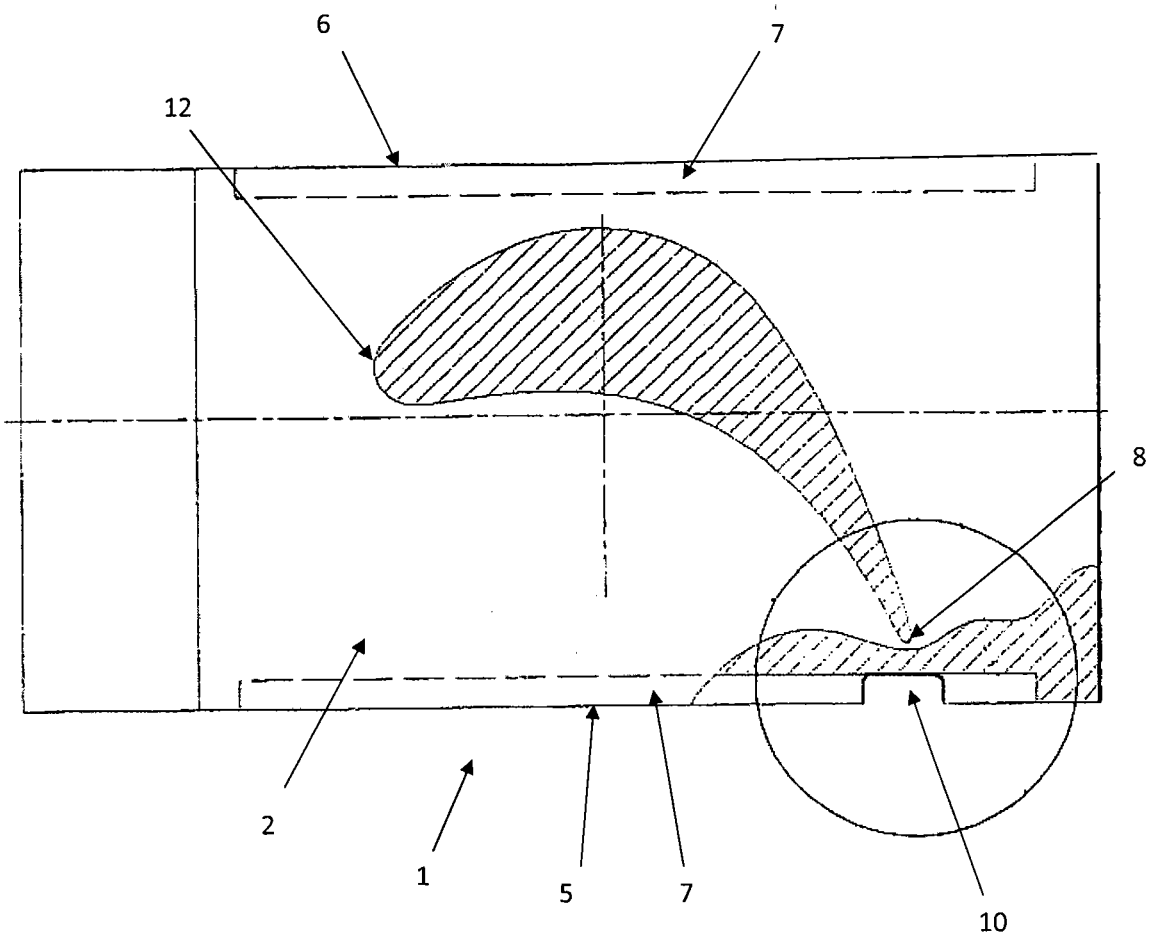
Figure 4:
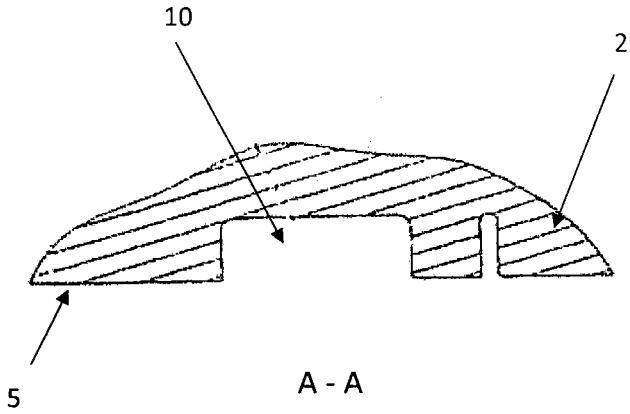

Referring to FIG. 3, which shows a cross section through a radially outer section of the vane portion together with a partial view in the area of the groove 7, it can be seen that the distance between the trailing edge 8 and the recess 10 in the circumferential direction of the gas turbine can be less than or equal to the depth of the groove 7. The stress concentrations are however reduced in this area due to the recess 10 and therefore the low cycle fatigue and the creep rate in these areas are reduced.

The depth of the recess 10 in the circumferential direction of the gas turbine is preferably substantially the same as the depth of the groove 7, as can be seen from FIG. 3. The width of the recess 10 in the longitudinal direction of the vane platform 2 is preferably between one and three times its depth and the profile of the recess is preferably substantially rectangular. The profile can however have other forms e.g. with side walls which extend at an angle to the longitudinal direction of the vane platform 2.

In FIGS. 1 to 4 the stator vane is provided with a radially outer vane platform 2. The stator vane can however also be provided with a radially inner vane platform (not shown) which is similarly provided with a groove 7 extending in the longitudinal direction of the vane platform whereby, in use, stress concentrations arise in the trailing edge area of the stator vane and in the radially inner vane platform. In this case a first side wall of the radially inner platform in the area of the trailing edge 8 can be provided with a recess extending radially inwards from the groove 7.

The preceding description of the embodiments according to the present invention serves only an illustrative purpose and should not be considered to limit the scope of the invention.

Particularly, in view of the preferred embodiments, the man skilled in the art different changes and modifications in the form and details can be made without departing from the scope of the invention. Accordingly the disclosure of the current invention should not be limiting. The disclosure of the current invention should instead serve to clarify the scope of the invention which is set forth in the following claims.

LIST OF REFERENCES

1 stator vane
2 platform
3 gas flow
4 space
5 first side wall
6 second side wall
7 groove
8 trailing edge
9 circle
10 recess
11 raised portion
12 leading edge
13 attachment element

What is claimed is:

1. A guide vane for a gas turbine comprising:

a vane body having a leading edge and a trailing edge; and a shroud extending at least between the leading edge and the trailing edge, the shroud having a first side wall and a second side wall extending essentially radially and in a longitudinal direction of the gas turbine, the first side wall having a groove disposed in a region of the trailing edge extending in a longitudinal direction of the shroud and configured to receive a sealing plate, the first side wall further having a clearance extending from the groove in a region of the trailing edge, wherein a depth of the clearance in a circumferential direction of the gas turbine is equal to a depth of the groove, and wherein a width of the clearance in the longitudinal direction of the shroud is between one to three times the depth of the clearance.

2. The guide vane as recited in claim 1, wherein the shroud is disposed radially outwardly with respect to the vane body.

3. The guide vane as recited in claim 1, wherein the clearance extends radially outward at right angles with respect to the groove.

4. The guide vane as recited in claim 1, wherein the clearance is disposed essentially aligned with the trailing edge in the longitudinal direction of the shroud.

5. The guide vane as recited in claim 1, wherein a distance between the trailing edge and the clearance in the circumferential direction of the gas turbine is less than or equal to the depth of the groove.

6. The guide vane as recited in claim 1, wherein a profile of the clearance has a rectangular shape.

7. The guide vane as recited in claim 1, wherein the side of the shroud opposite the clearance includes an elevation in a region of the clearance.

8. The guide vane as recited in claim 1, wherein the clearance is disposed in a radial inner portion of the shroud and extends radially inward essentially at a right angle with respect to the groove.

* * * * *